US010381137B2

(12) United States Patent
Farkas et al.

(10) Patent No.: US 10,381,137 B2
(45) Date of Patent: Aug. 13, 2019

(54) SYSTEM AND METHOD FOR MITIGATING SIGNAL PROPAGATION SKEW BETWEEN SIGNAL CONDUCTING WIRES OF A SIGNAL CONDUCTING CABLE

(71) Applicant: DELL PRODUCTS, LP, Round Rock, TX (US)

(72) Inventors: Sandor Farkas, Round Rock, TX (US); Bhyrav M. Mutnury, Round Rock, TX (US)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 15/627,000

(22) Filed: Jun. 19, 2017

(65) Prior Publication Data

US 2018/0366243 A1 Dec. 20, 2018

(51) Int. Cl.

| | |
|---|---|
| ***H01B 11/04*** | (2006.01) |
| ***H01B 11/20*** | (2006.01) |
| *H01B 11/00* | (2006.01) |
| *H01B 7/02* | (2006.01) |

(52) U.S. Cl.

CPC ..... *H01B 11/20* (2013.01); *H01B 7/02* (2013.01); *H01B 11/002* (2013.01)

(58) Field of Classification Search

CPC ..... H01B 11/04; H01B 11/06

USPC ..... 174/113 R, 115, 27

See application file for complete search history.

(56) References Cited

U.S. PATENT DOCUMENTS

| | | | | |
|---|---|---|---|---|
| 5,767,442 | A * | 6/1998 | Eisenberg | H01B 7/0892 174/113 R |
| 6,452,107 | B1 * | 9/2002 | Kebabjian | H01B 11/002 174/113 R |
| 6,952,148 | B2 | 10/2005 | Snyder et al. | |
| 7,030,321 | B2 * | 4/2006 | Clark | H01B 11/02 174/113 R |
| 7,982,132 | B2 * | 7/2011 | Hopkinson | H01B 11/002 174/110 R |
| 9,589,701 | B2 | 3/2017 | Mutnury et al. | |
| 2004/0055771 | A1 * | 3/2004 | Wiekhorst | H01B 11/002 174/15.1 |
| 2004/0155727 | A1 | 8/2004 | Snyder et al. | |
| 2005/0056454 | A1 * | 3/2005 | Clark | H01B 11/02 174/113 R |
| 2006/0207786 | A1 * | 9/2006 | Clark | H01B 11/002 174/110 R |

(Continued)

OTHER PUBLICATIONS

M. Jost, "Tunable Dielectric Delay Line Phase Shifter Based on Liquid Crystal Technology for a SPDT in a Radiometer Calibration Scheme AT 100 GHz," Microwave Symposium IMS 2016; pp. 1-3; http://ieeexplore.ieee.org/document/7540007/.

(Continued)

*Primary Examiner* — Chau N Nguyen

(74) *Attorney, Agent, or Firm* — Larson Newman, LLP

(57) ABSTRACT

A cable includes first and second electrically conducting wires, each of the two wires surrounded by a respective isolating dielectric material for a length of the respective wire. A signal propagation skew between the first and second wires may be detected, and a dielectric constant associated with a wire may be changed to mitigate the detected signal propagation skew. The dielectric constant may be changed by removing or adding dielectric material from or to the wire.

12 Claims, 9 Drawing Sheets

(56) References Cited

U.S. PATENT DOCUMENTS

| | | | | |
|---|---|---|---|---|
| 2008/0173464 | A1* | 7/2008 | Nair | H01B 7/0876<br>174/117 FF |
| 2010/0307790 | A1* | 12/2010 | Okano | H01B 7/361<br>174/113 C |
| 2012/0024569 | A1* | 2/2012 | Jiang | H01B 3/445<br>174/115 |
| 2012/0048591 | A1* | 3/2012 | Gareis | H01B 7/0823<br>174/102 R |
| 2015/0170794 | A1 | 6/2015 | Mutnury et al. | |

OTHER PUBLICATIONS

Takao Kuki, "Design of a microwave variable delay line using liquid crystal, and a study of its insertion loss," Electronics and Communications in Japan, Jan. 10, 2002, pp. 1-7; http://onlinelibrary.wiley.com/doi/10.1002/ecjb.1091/abstract.

* cited by examiner

SYSTEM AND METHOD FOR MITIGATING SIGNAL PROPAGATION SKEW BETWEEN SIGNAL CONDUCTING WIRES OF A SIGNAL CONDUCTING CABLE

FIELD OF THE DISCLOSURE

This disclosure generally relates to information handling systems, and more particularly relates to mitigating signal propagation skew between signal conducting wires of a signal conducting cable.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, reservations, enterprise data storage, or global communications. In addition, information handling systems may include a variety of hardware and software resources that may be configured to process, store, and communicate information and may include one or more computer systems, data storage systems, and networking systems.

Information handling systems may be communicatively connected by cables with electrically conducting wires for signal propagation.

SUMMARY

A cable may include first and second electrically conducting wires, each of the two wires surrounded by a respective isolating dielectric material for a length of the respective wire. A signal propagation skew between the first and second wires may be detected, and a dielectric constant associated with a wire may be changed to mitigate the detected signal propagation skew. The dielectric constant may be changed by removing dielectric material from or adding dielectric material to the wire.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION

The following description in combination with the Figures is provided to assist in understanding the teachings disclosed herein. The following discussion will focus on specific implementations and embodiments of the teachings. This focus is provided to assist in describing the teachings, and should not be interpreted as a limitation on the scope or applicability of the teachings. However, other teachings can certainly be used in this application. The teachings can also be used in other applications, and with several different types of architectures, such as distributed computing architectures, client/server architectures, or middleware server architectures and associated resources.

Figure 1:
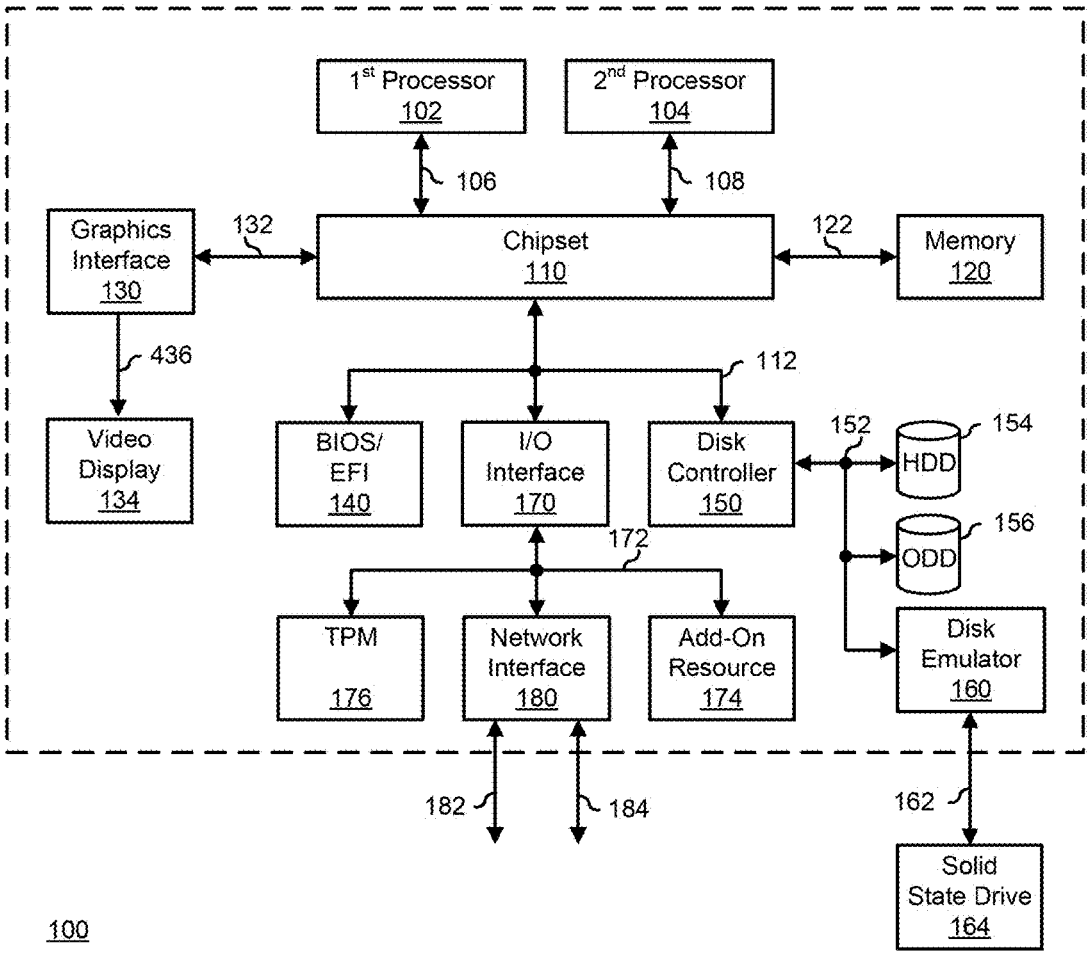
FIG. 1 is a block diagram illustrating a generalized information handling system according to an embodiment of the present disclosure.

FIG. 1 illustrates a generalized embodiment of information handling system 100. For purpose of this disclosure information handling system 100 can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 100 can be a processor system which may be a System-on-a-Chip (SoC), a personal computer, a laptop computer, a smart phone, a tablet device or other consumer electronic device, storage array, a network server, a network storage device, a switch router or other network communication device, or any other suitable device and may vary in size, shape, performance, functionality, and price. Further, information handling system 100 can include processing resources for executing machine-executable code, such as a central processing unit (CPU), a programmable logic array (PLA), an embedded device such as a SoC, or other control logic hardware. Information handling system 100 can also include one or more computer-readable medium for storing machine-executable code, such as software or data. Additional components of information handling system 100 can include one or more storage devices that can store machine-executable code, one or more communications ports for communicating with external devices, and various input and output (I/O) devices, such as a keyboard, a mouse, and a video display. Information handling system 100 can also include one or more buses operable to transmit information between the various hardware components.

Information handling system 100 can include devices or modules that embody one or more of the devices or modules described above, and operates to perform one or more of the methods described above. Information handling system 100 includes a processors 102 and 104, a chipset 110, a memory 120, a graphics interface 130, include a basic input and output system/extensible firmware interface (BIOS/EFI) module 140, a disk controller 150, a disk emulator 160, an input/output (I/O) interface 170, and a network interface 180. Processor 102 is connected to chipset 110 via processor interface 106, and processor 104 is connected to the chipset via processor interface 108. Memory 120 is connected to chipset 110 via a memory bus 122. Graphics interface 130 is connected to chipset 110 via a graphics interface 132, and provides a video display output 136 to a video display 134. In a particular embodiment, information handling system 100 includes separate memories that are dedicated to each of processors 102 and 104 via separate memory interfaces. An example of memory 120 includes random access memory (RAM) such as static RAM (SRAM), dynamic RAM (DRAM), non-volatile RAM (NV-RAM), or the like, read only memory (ROM), another type of memory, or a combination thereof.

BIOS/EFI module 140, disk controller 150, and I/O interface 170 are connected to chipset 110 via an I/O channel 112. An example of I/O channel 112 includes a Peripheral Component Interconnect (PCI) interface, a PCI-Extended (PCI-X) interface, a high speed PCI-Express (PCIe) interface, another industry standard or proprietary communication interface, or a combination thereof. Chipset 110 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/EFI module 140 includes BIOS/EFI code operable to detect resources within information handling system 100, to provide drivers for the resources, initialize the resources, and access the resources. BIOS/EFI module 140 includes code that operates to detect resources within information handling system 100, to provide drivers for the resources, to initialize the resources, and to access the resources.

Disk controller 150 includes a disk interface 152 that connects the disc controller to a hard disk drive (HDD) 154, to an optical disk drive (ODD) 156, and to disk emulator 160. An example of disk interface 152 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 160 permits a solid-state drive 164 to be connected to information handling system 100 via an external interface 162. An example of external interface 162 includes a USB interface, an IEEE 1394 (Firewire) interface, a proprietary interface, or a combination thereof. Alternatively, solid-state drive 164 can be disposed within information handling system 100.

I/O interface 170 includes a peripheral interface 172 that connects the I/O interface to an add-on resource 174, to a TPM 176, and to network interface 180. Peripheral interface 172 can be the same type of interface as I/O channel 112, or can be a different type of interface. As such, I/O interface 170 extends the capacity of I/O channel 112 when peripheral interface 172 and the I/O channel are of the same type, and the I/O interface translates information from a format suitable to the I/O channel to a format suitable to the peripheral channel 172 when they are of a different type. Add-on resource 174 can include a data storage system, an additional graphics interface, a network interface card (NIC), a sound/video processing card, another add-on resource, or a combination thereof. Add-on resource 174 can be on a main circuit board, on separate circuit board or add-in card disposed within information handling system 100, a device that is external to the information handling system, or a combination thereof.

Network interface 180 represents a NIC disposed within information handling system 100, on a main circuit board of the information handling system, integrated onto another component such as chipset 110, in another suitable location, or a combination thereof. Network interface device 180 includes network channels 182 and 184 that provide interfaces to devices that are external to information handling system 100. In a particular embodiment, network channels 182 and 184 are of a different type than peripheral channel 172 and network interface 180 translates information from a format suitable to the peripheral channel to a format suitable to external devices. An example of network channels 182 and 184 includes InfiniBand channels, Fibre Channel channels, Gigabit Ethernet channels, proprietary channel architectures, or a combination thereof. Network channels 182 and 184 can be connected to external network resources (not illustrated). The network resource can include another information handling system, a data storage system, another network, a grid management system, another suitable resource, or a combination thereof.

For the purposes of this disclosure, an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system can be a personal computer, a laptop computer, a smart phone, a tablet device or other consumer electronic device, a network server, a network storage device, a switch, a router, or another network communication device, or any other suitable device and may vary in size, shape, performance, functionality, and price. Further, an information handling system can include processing resources for executing machine-executable code, such as a Central Processing Unit (CPU), a Programmable Logic Array (PLA), an embedded device such as a System-On-a-Chip (SoC), or other control logic hardware. An information handling system can also include one or more computer-readable medium for storing machine-executable code, such as software or data. Additional components of an information handling system can include one or more storage devices that can store machine-executable code, one or more communications ports for communicating with external devices, and various Input and Output (I/O) devices, such as a keyboard, a mouse, and a video display.

Information handling systems may include one or more cables. Cables may connect information handling systems, for example, or may connect components of information handling systems, internal to the information handling systems. Components and information handling systems may communicate over the connections provided by the cables. An example of an information handling system is a server. Multiple servers may be stored in a server rack.

Cables include one or more electrically conductive wires for conducting or propagating signals. A cable may include a pair of electrically conducting wires for propagating signals along the cable, to allow information handling systems to communicate over the cable by transmitting and receiving signals over the wires.

Figure 2:
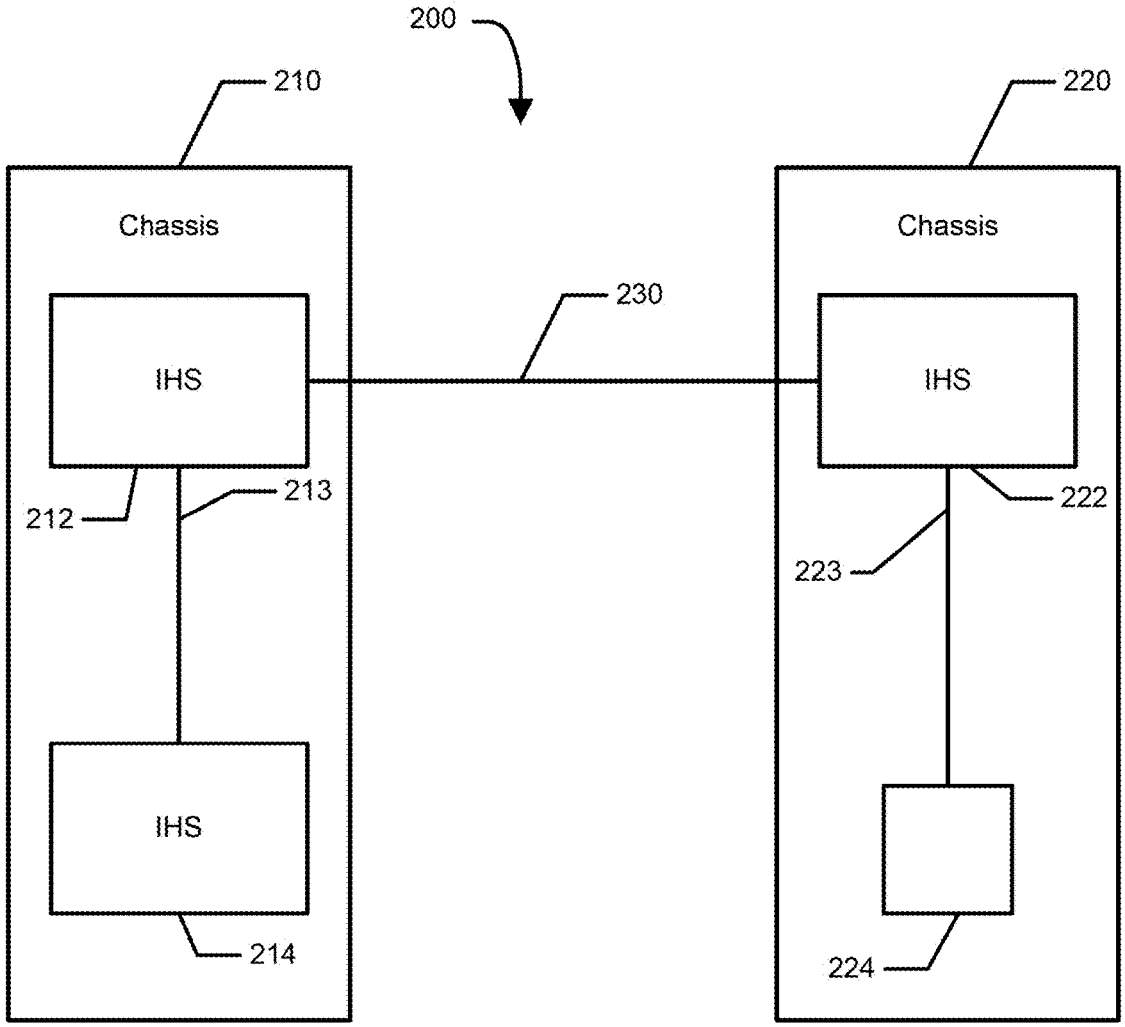
FIG. 2 illustrates an information handling systems communicatively connected by cables according to an embodiment of the present disclosure.

FIG. 2 shows a system 200 with cables connecting devices such as information handling systems and components. System 200 includes chassis 210 and chassis 220. Chassis 210 stores information handling systems 212 and 214. Information handling systems 212 and 214 are connected by cable 213 interior to chassis 210. Information handling system 212 and information handling system 214 may communicate over cable 213. Chassis 220 stores information handling system 222 and component 224. Component 224 may be a peripheral or component of information handling system 222. Information handling system 222 and component 224 are connected by cable 223 interior to chassis 220. Information handling system 212 and information handling system 222 are connected by cable 230, and a portion of cable 230 may be external to chassis 210 and chassis 220. Information handling system 212 and information handling system 222 may communicate over cable 230.

Figure 3:
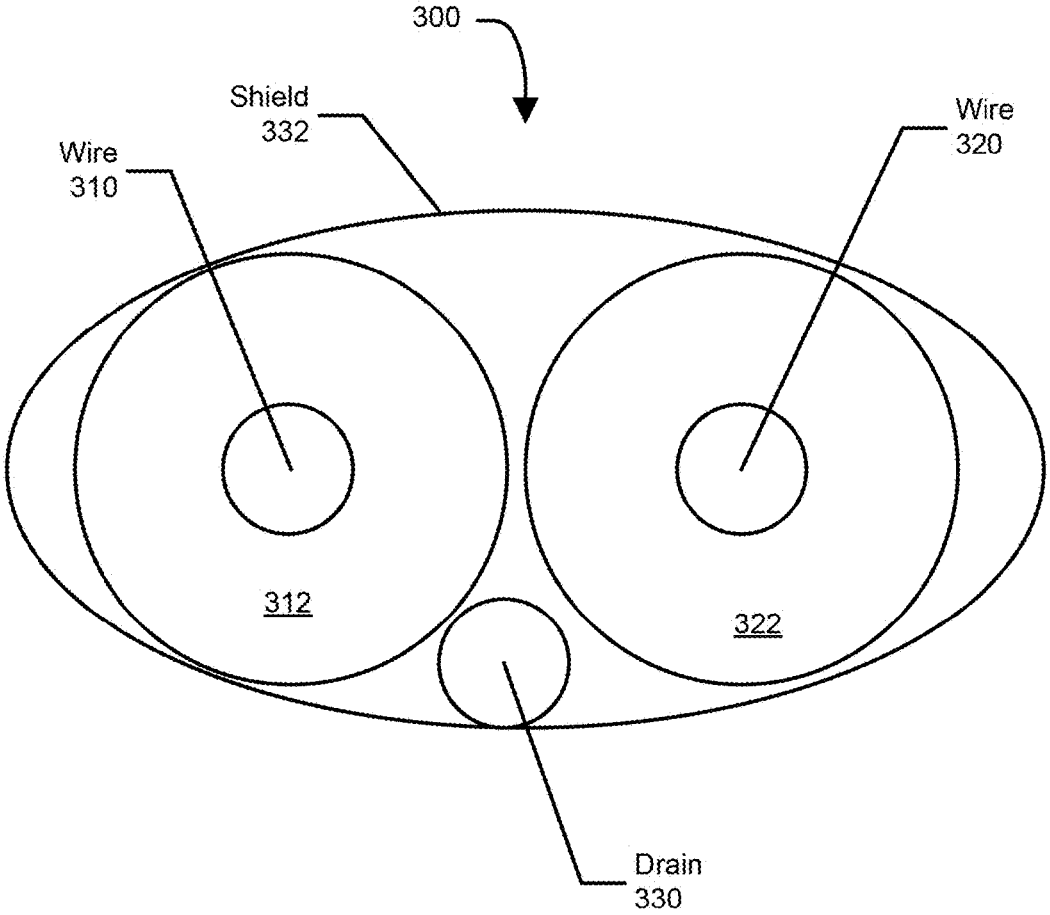
FIG. 3 illustrates a cross section of a cable according to an embodiment of the present disclosure.

FIG. 3 shows a cross section of an example cable 300 which is a shielded single-drain dual axial cable. Cable 300 includes conducting wires 310 and 320 which are formed from an electrically conducting material, such as, for example, copper. As shown, conducting wires 310 and 320 are substantially parallel and substantially adjacent in cable 300. In cable 300, wire 310 is isolated by dielectric 312 surrounding the cylindrical circumference of wire 310 and wire 320 is isolated by dielectric 322 surrounding the cylindrical circumference of wire 320. Cable 300 further includes a drain 330 formed from an electrically conducting material, such as, for example, copper. Cable 300 also includes shield 332 surrounding wires 310 and 320 together with drain 330. In cable 300, wires 310 and 320 may form a differential pair of conducting wires for signal propagation and communication. Thus, information handling systems may communicate using cable 300 by communicating signals over wires 310 and 320.

Cables may carry differential signals using two or more conductors such as wires 310 and 320 in cable 300 of FIG. 3. Cables are typically constructed from either twinax or coax type wires to implement the two conductors needed to carry differential signals. It is desirable that differential signals propagate at the same rate over the (conducting) wires such that the differential signals arrive together and there is not a 'skew' in the differential signals propagating over the wires in the cable caused by different signal propagation rates in the different wires in a cable. That is, it is desirable that signals propagate in the two wires at the same speed, such that there is not a temporal differential or 'skew' in the arrival times of signals provided to the conducting wires at the same time. Thus, it is desirable to match the two conducting wires (conductors) in a differential pair of conducting wires in a cable to prevent skew.

However, there is an inherent skew between wires in cables. The geometry and material variations and differences in wires will result in some skew between the conducting wires (conductors) in an individual cable, and different cables will have different skews between conductors due to manufacturing tolerances. As discussed above, in a cable, conducting wires (or the circumference thereof) may be surrounded by a respective isolating dielectric material.

Signal propagation delay in a conductor is proportional to the length of the conductor, and also with the square root of the dielectric constant as shown below by Equation 1:

$$td=\lambda((\sqrt{\varepsilon r})/c), \qquad \text{Eq. 1}$$

where εr is the dielectric constant, c is velocity of light, and λ is length of the cable.

Thus, as shown by Equation 1, propagation delay in a conductor may be modified by modifying the dielectric constant surrounding the conductor. The effective dielectric constant can be raised to slow down a signal, or can be lowered to speed up the signal. Typical cable dielectrics constants of dielectrics used in cables are in the range of 2-5. The dielectric constant of air is 1. Therefore replacing the cable dielectric with air will lower the effective dielectric constant and lower the signal propagation delay. This can be done by removing some of the dielectric material, for example, near an end of the cable. For example, if 10% of the dielectric is removed over 1 inch of the total length then the cable delay can be reduced by 10 ps. Table 1 below shows a look-up table for how much dielectric should be removed and the length that it should be removed to achieve a 10 ps delay.

TABLE 1

| εr of dielectric material | Percent of dielectric material removed | Length of dielectric material removed |
|---|---|---|
| 4 | 2% | 5 inches |
| 4 | 5% | 2 inches |
| 4 | 10% | 1 inch |
| 4 | 15% | 0.75 inch |
| 4 | 20% | 0.5 inch |

Similarly, to compensate for cable skew, the effective dielectric constant of a wire may be increased to increase the signal propagation delay. Dielectric material (for example, epoxy, paint, foam) having a dielectric constant may be added to the exposed wires of a cable where the conductor meets a connector. This will increase the effective dielectric constant of the wire and increase the signal propagation delay in the wire. A 10 ps mismatch can be compensated by adding dielectric with εr=5 for 50 mils of the wire. Table 2 below provides the look-up table for added dielectric material length to achieve the desired delay.

TABLE 2

| εr of dielectric material | Delay mismatch (ps) | Length of dielectric added (mils) |
|---|---|---|
| 5 | 10 | 50 |
| 5 | 9 | 47 |
| 5 | 8 | 42 |
| 5 | 7 | 36 |
| 5 | 6 | 31 |
| 5 | 5 | 25 |

A dielectric material with a heightened dielectric constant may also be added to a wire to increase the effective dielectric constant of a wire and increase the signal propagation delay in the wire to compensate for skew with another wire. Table 3 below provides the look-up table for a dielectric material with a dielectric constant to cover 50 mils of conductor:

TABLE 3

| εr of dielectric material | Delay mismatch (ps) | Length of dielectric added (mils) |
|---|---|---|
| 5 | 10 | 50 |
| 4.7 | 9 | 50 |
| 3.8 | 8 | 50 |
| 2.8 | 7 | 50 |
| 2.2 | 6 | 50 |
| 1.5 | 5 | 50 |

Thus, to compensate for signal propagation skew between two differential conducting wires in a cable, the dielectric constant of the wire with the slower propagation may be reduced by removing dielectric material, thereby effectively substituting air for the dielectric material and lowering the effective dielectric constant and increasing the signal propagation in the wire to lower the signal propagation delay.

Similarly, to compensate for signal propagation skew between two differential conducting wires in a cable, the dielectric constant of the wire with the faster propagation may be increased by adding dielectric material, thereby effectively increasing the effective dielectric constant and decreasing the signal propagation in the wire to delay the signal propagation. The dielectric constant may be increased by adding additional dielectric material or increasing the dielectric constant of the dielectric material.

Thus, by changing the dielectric constant associated with a wire of a cable, the inherent signal propagation skew between wires of a cable may be rectified. As disclosed above, dielectric material may be added or removed from one of the wires of a cable to rectify a relative signal propagation skew between wires of the cable by increasing or reducing the propagation speed of a signal traversing the wire. The dielectric constant associated with a wire, namely the dielectric constant of the dielectric isolating a wire, may be modified during manufacture of a cable by an Original Equipment Manufacturer (OEM) manufacturing the cable, or subsequent to manufacture of the cable by the OEM.

For example, the OEM could manufacture a cable on its manufacturing premises, and then test the cable for signal propagation skew between wires of the cable. If the signal propagation skew is higher than a desired threshold, the dielectric constant of a wire may be increased or lowered as disclosed herein to rectify skew between wires of the cable. Using the disclosure herein, subsequent to manufacture of a cable by the OEM, if an undesirable amount of propagation skew is detected between wires in the cable, the dielectric constant of a wire may be increased or lowered as disclosed herein to rectify skew between wires of the cable.

Figure 4A:
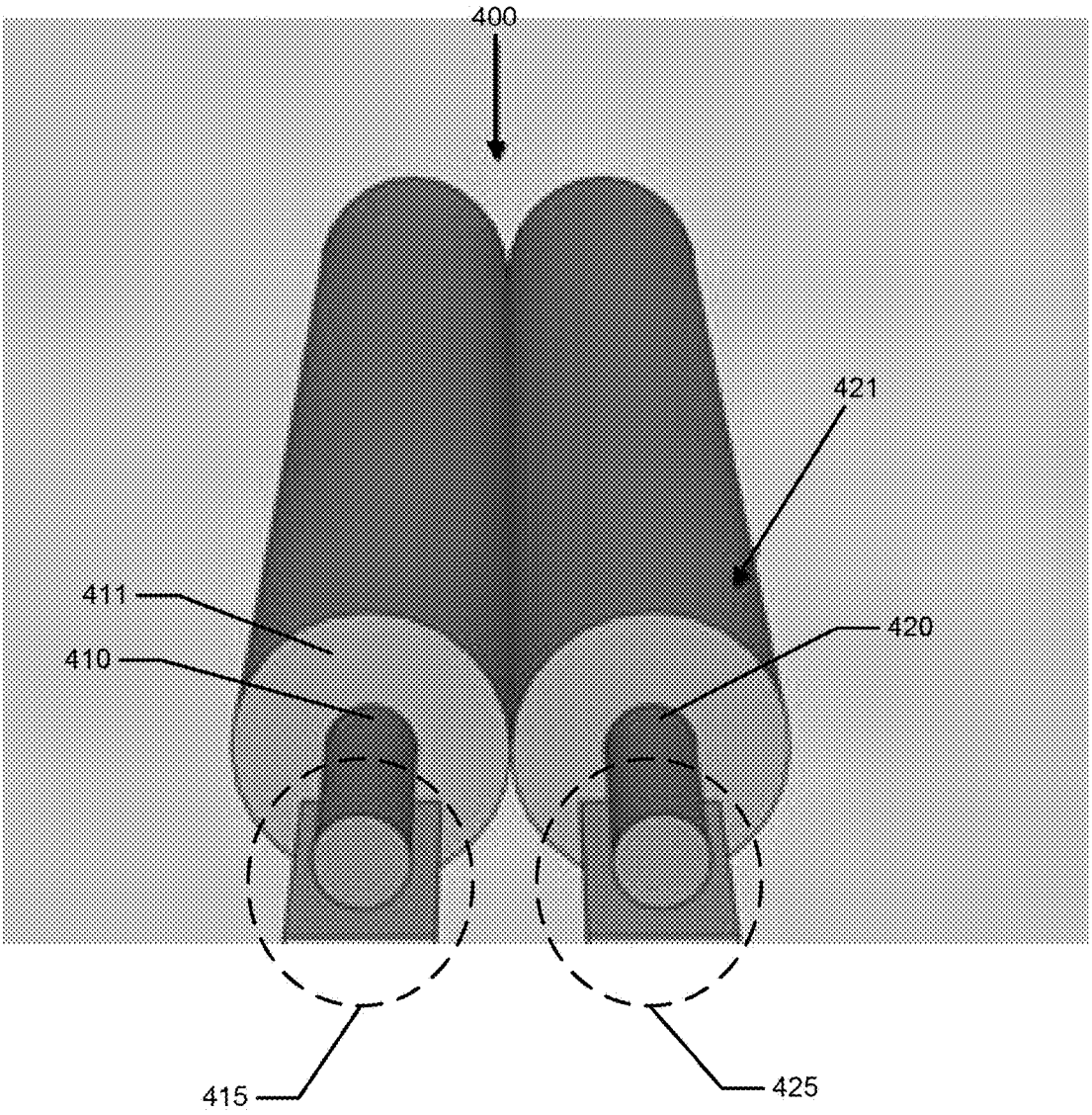
FIGS. 4*a*-4*d* illustrate embodiments of a cable according to an embodiment of the present disclosure.
Figure 4B:
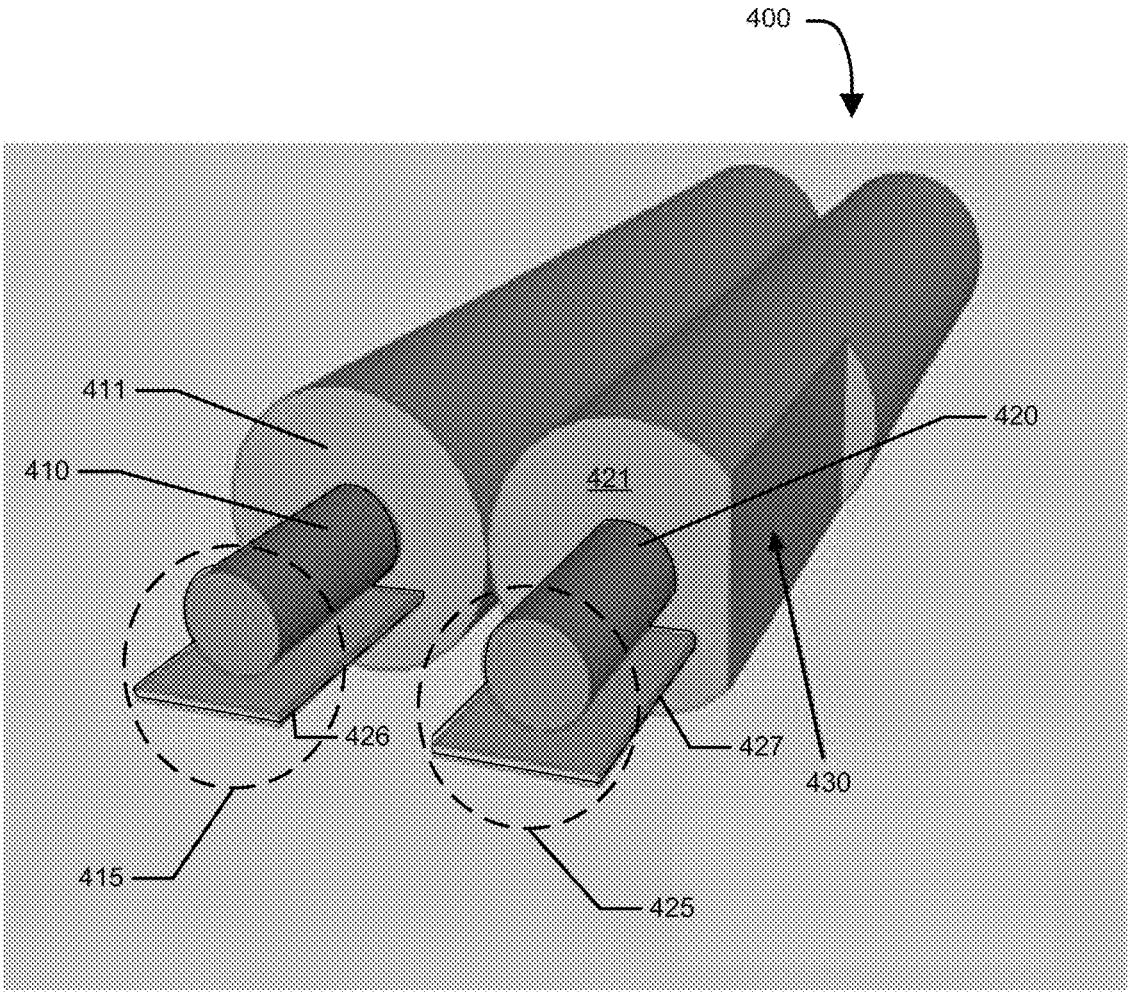

FIGS. 4*a*-4*d* show a simplified dual axial cable 400 with drain wire and wrapping omitted. FIG. 4*b* shows a simplified dual axial cable 400 with protective covers 426 and 427. Cable 400 includes conducting wires 410 and 420 which are formed from an electrically conducting material, such as, for example, copper. As shown, conducting wires 410 and 420 are substantially parallel and substantially adjacent in cable 400. In cable 400, wire 410 is isolated by dielectric 411 surrounding the cylindrical circumference of wire 410 for a portion of the length of wire 410; similarly, wire 420 is isolated by dielectric 421 surrounding the cylindrical circumference of wire 420 for a portion of the length of wire 411. As shown, at an end of cable 400, wire 410 terminates in a spade connector 415 and wire 420 terminates in spade connector 425. Spade connector 415 is electrically connected to wire 410 and may be made of an electrically conducting material, such as, for example, copper. Spade connector 425 is electrically connected to wire 420 and may be made of an electrically conducting material, such as, for example, copper.

Figure 4C:
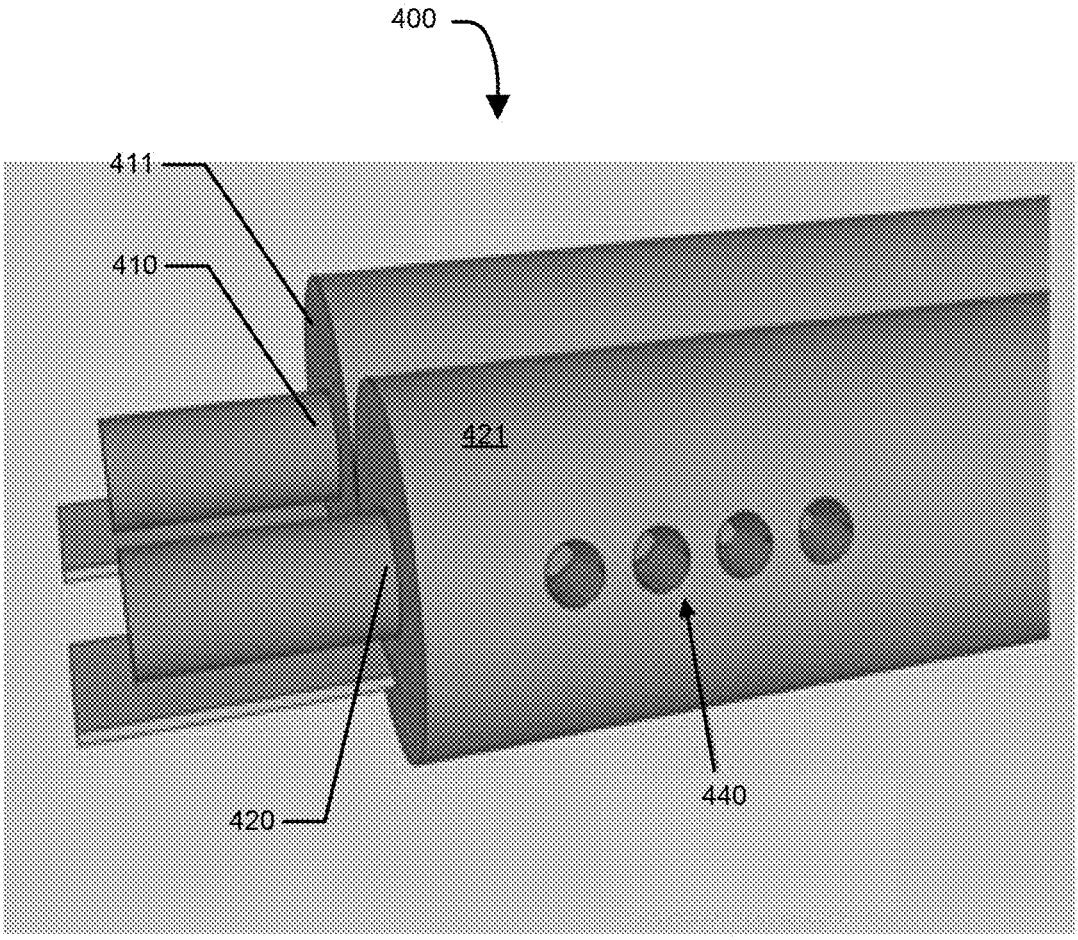
Figure 4D:
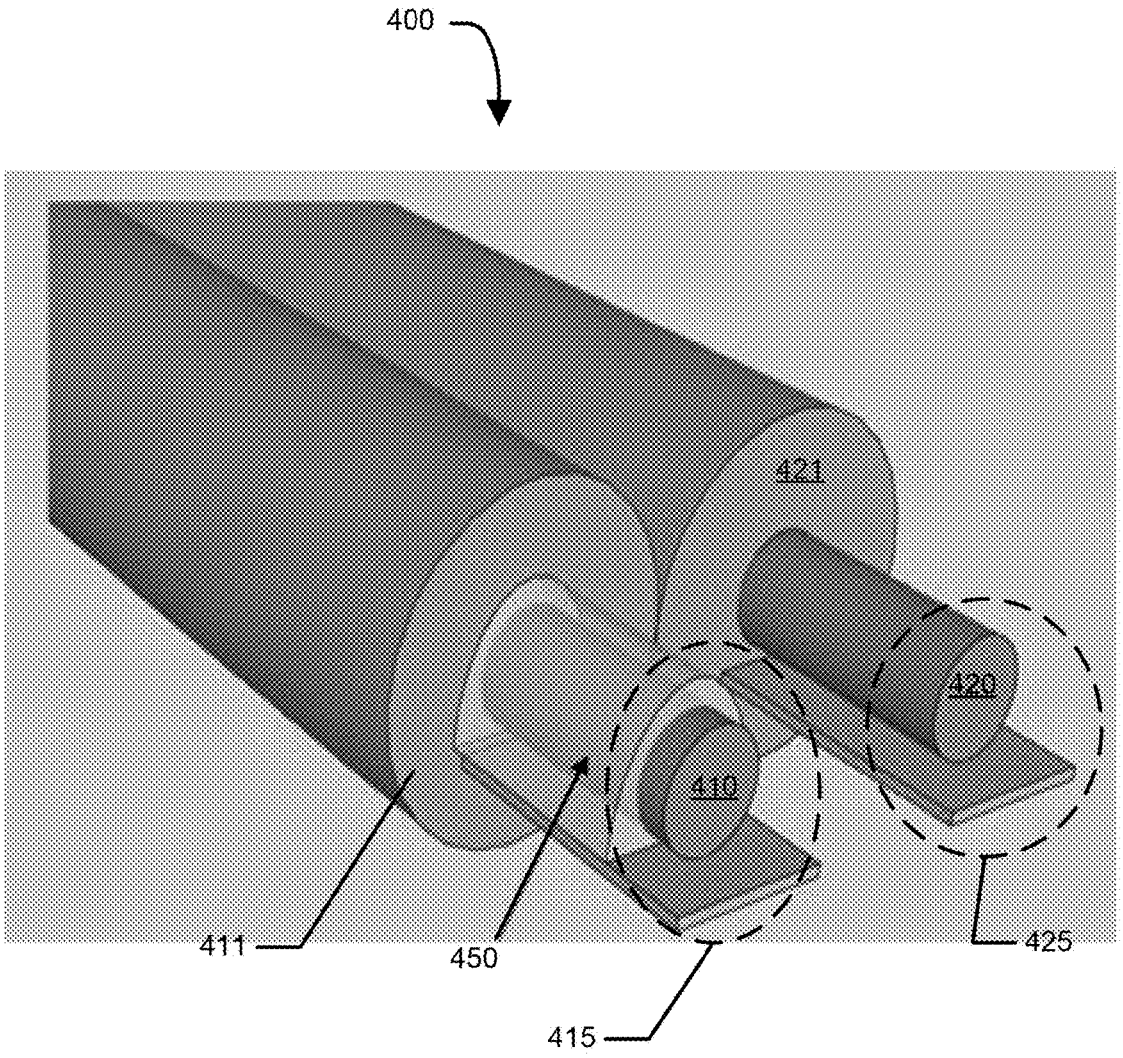

In cable 400, signals may propagate over wires 410 and 420. There may be a skew, or signal propagation differential, between wires 410 and 420 subsequent to a manufacture of cable 400 by an OEM. FIGS. 4*b*-4*d* illustrate varying dielectric constants associated with wires 410 or 420 to mitigate the signal propagation skew between wires 410 and 420 of cable 400 to allow for signals to propagate along wires 410 and 420 at a same speed within a skew threshold. In cable 400, for the purposes of FIGS. 4*b*-4*d*, wire 420 provides a slower or delayed path for signal propagation relative to wire 410 such that there is a signal propagation skew between wires 410 and 420 and a signal travels faster over wire 410 than wire 420 in cable 400.

In FIG. 4*b*, to mitigate signal propagation skew between wires 410 and 420 of cable 400, the dielectric constant associated with wire 420 is changed by removing dielectric material of dielectric 421 surrounding wire 420 in the relative vicinity of spade connector 425 of wire 420 at 430, thereby substituting air with a dielectric constant of approximately 1 for the removed dielectric material, thereby modifying the dielectric constant associated with wire 420. Assuming the dielectric constant of dielectric 421 is greater than 1, removing material will reduce the dielectric constant associated with wire 420, increasing the signal propagation rate over wire 420 and therefore mitigating the signal propagation skew between wires 410 and 420 in cable 400. The amount of material of dielectric 421 removed will determine the increase in propagation speed of wire 420 to mitigate signal propagation skew between wires 410 and 420. Material may be removed from dielectric 421 at 430 by a laser (lasing or ablation) or a mechanical cutting tool (cutting or shaving). As shown, location 430 is on an outer portion of dielectric 421 opposed to (that is, farthest from) wire 410 where electric field formed around wire 420 is relatively stronger.

In FIG. 4*c*, to mitigate signal propagation skew between wires 410 and 420 of cable 400, the dielectric constant associated with wire 420 is changed by removing dielectric material of dielectric 421 surrounding wire 420 at 440, thereby substituting air with a dielectric constant of approximately 1 for the removed dielectric material, thereby modifying the dielectric constant associated with wire 420. Assuming the dielectric constant of dielectric 421 is greater than 1, removing material will reduce the dielectric constant associated with wire 420, increasing the signal propagation rate over wire 420 and therefore mitigating the signal propagation skew between wires 410 and 420 in cable 400. The amount of material of dielectric 421 removed will determine the increase in propagation speed of wire 420 to mitigate signal propagation skew between wires 410 and 420. As shown, location 440 is on an outer portion of dielectric 421 opposed to (that is, farthest from) wire 410 where electric field formed around wire 420 are relatively stronger.

Material may be removed from dielectric 421 at 440 by a laser (for example drilling dielectric 421 by lasing or ablation). While as shown, 440 is located in the relative vicinity of spade connector 425 of wire 420, this is by way of example, and dielectric 421 may be removed anywhere along the length of cable 400. Techniques illustrated in FIGS. 4*b* and 4*c* may be combined to finely compensate wires in a cable to mitigate skew between the wires.

Turning to FIG. 4*d*, as discussed above, wire 420 provides a slower or delayed path for signal propagation relative to wire 410 such that there is a signal propagation skew between wires 410 and 420 and a signal travels faster over wire 410 than wire 420 in cable 400. In FIG. 4*d*, the dielectric constant associated with wire 410 is changed by adding dielectric material 450 to a portion of spade connector 415 electrically connected to wire 410. Adding dielectric material 450 to a portion of the spade connector 415 electrically connected to wire 410 will increase the dielectric constant associated with wire 410, reducing the signal propagation speed over wire 410 and therefore mitigating the signal propagation skew between wires 410 and 420 in cable 400. The amount of dielectric material added to spade connector 415 and the dielectric constant of the dielectric material will determine the decrease in propagation speed of wire 410 to mitigate signal propagation skew between wires 410 and 420.

Figure 5:
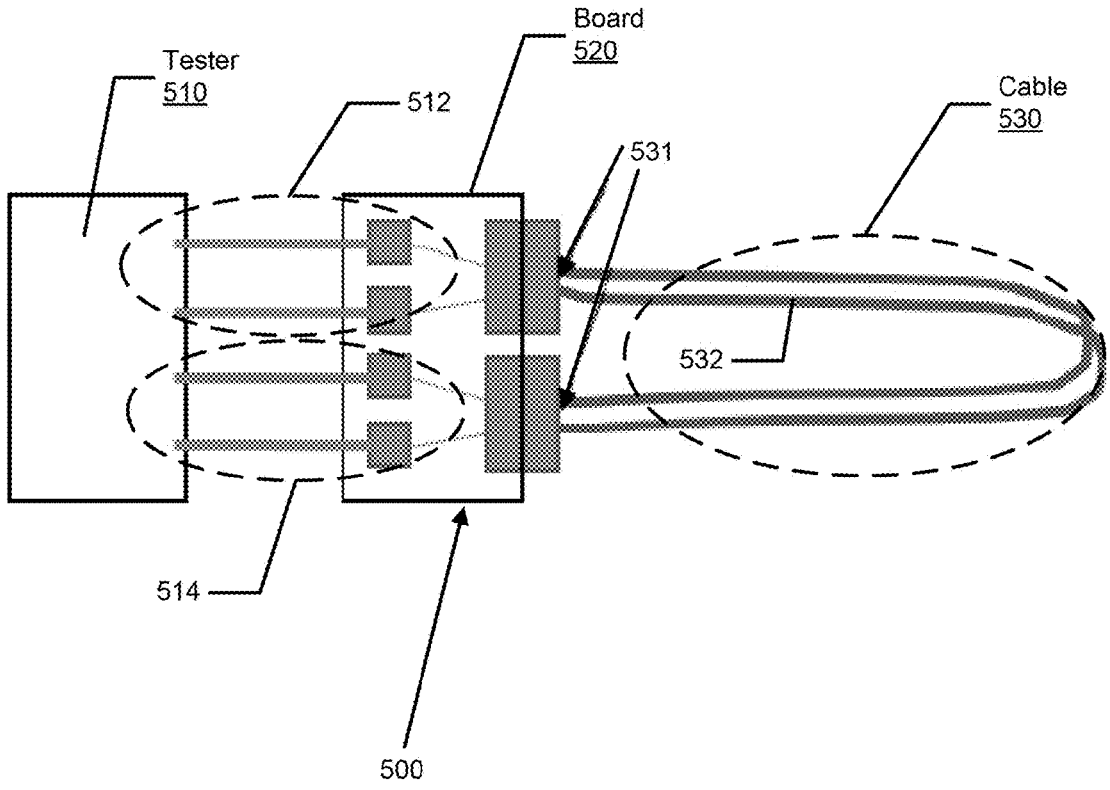
FIG. 5 illustrates a cable test system according to an embodiment of the present disclosure.

FIG. 5 shows a cable test system 500 for determining a signal propagation skew between conducting wires of a cable. Cable test system 500 includes tester 510 and connection board 520. Tester 510 may be vector network analyzer or time domain reflectometer, and connection board 520 may be a break-out board. A cable 530 with conducting wires 531 and 532 may be connected to connection board 520 as shown.

In testing of cable 530 with cable test system 500, tester 510 may provide a pair of signals with known skew to wires 531 and 532 over differential connections 512; tester 510 may then receive the pair of signals after the pair of signals has traversed wires 531 and 532 of cable 530 over differential connections 514, and the tester may determine increases or decreases in the known skew of the pair of signals to detect the signal propagation skew between wires 531 and 532 of cable 530. A dielectric constant associated with one or both of wires 531 and 532 may be changed as discussed above to mitigate signal propagation skew between wires 531 and 532 of cable 530.

The above process applied to cable 530 using system 500 may be performed iteratively to mitigate skew. The above process may be performed on a cable that is electrically complete but which has yet to have had a protective cover attached to the connector areas of the cable. Cable test system 500 may implement a closed loop control, where the dielectric is changed by addition or removal of dielectric until the skew between wires 531 and 532 is below a threshold.

Figure 6:
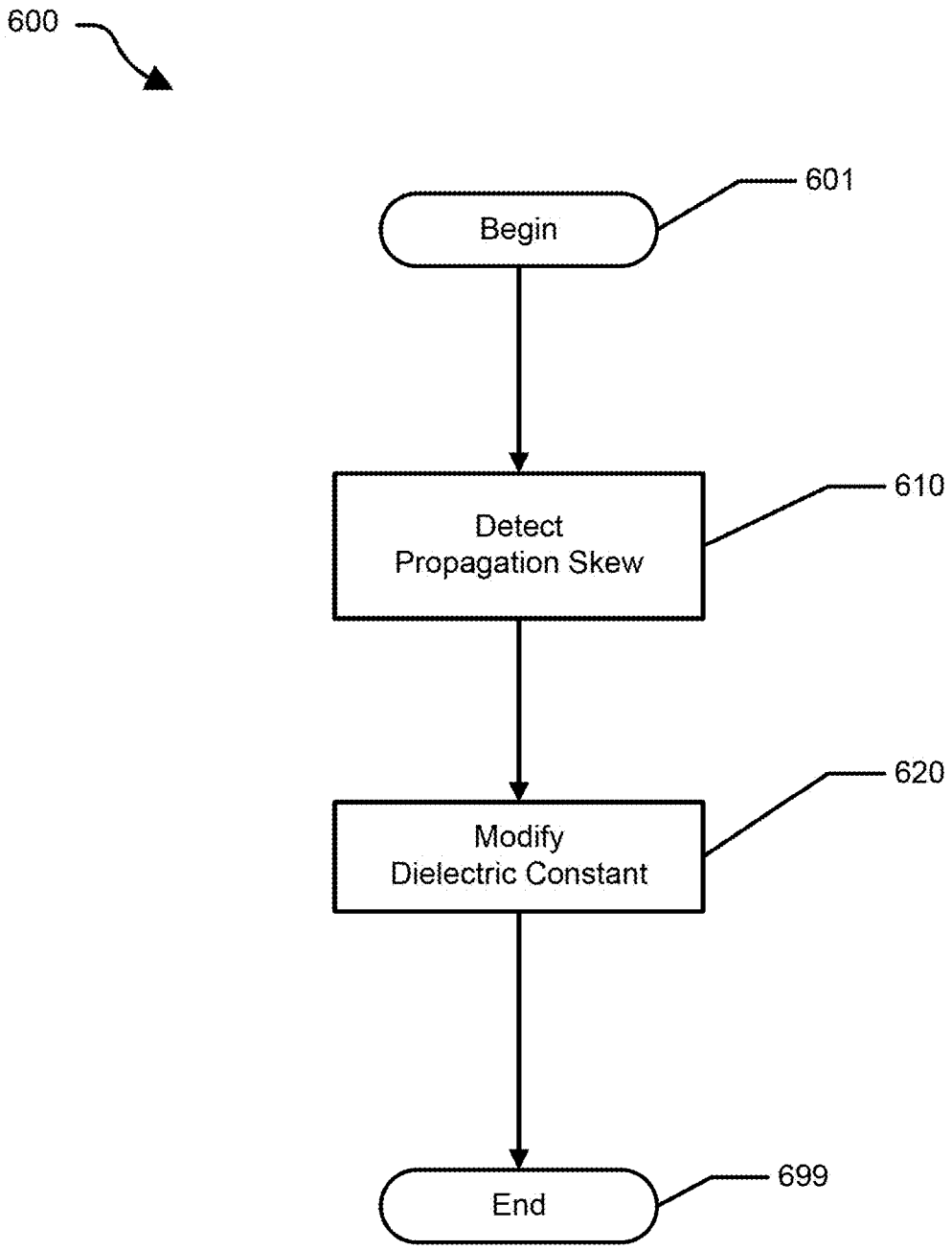
FIG. 6 illustrates a flowchart for mitigating signal propagation skew of a cable according to an embodiment of the present disclosure.

FIG. 6 shows a flowchart 600 for mitigating propagation skew between wires in a cable as disclosed herein. At 601, 600 begins. At 610, signal propagation skew between two or more wires of a cable is detected. At 620, a dielectric constant of a dielectric of a wire is changed to rectify the detected signal propagation skew. For example, material may be removed from a dielectric isolating a wire, or dielectric may be added to an exposed portion of a wire. At 699, 600 ends; 600 may be performed iteratively including iteratively detecting propagation skew and changing a dielectric constant of a dielectric of a wire to reduce propagation skew between wires below a desired threshold.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A cable comprising:

a first electrically conducting wire with a first circumference and a first length;

a first dielectric material surrounding the first circumference for a portion of the first length to isolate the first electrically conducting wire;

a second electrically conducting wire with a second circumference and a second length; and a second dielectric material surrounding the second circumference for a portion of the second length to isolate the second electrically conducting wire, wherein the first electrically conducting wire and the second electrically conducting wire form a pair of conducting wires, wherein a signal propagation skew between the first electrically conducting wire and the second electrically conducting wire is detected, wherein signal travels faster over the first electrically conducting wire than the second electrically conducting wire, and a second dielectric constant of the second electrically conducting wire is changed to mitigate the signal propagation skew, and wherein the second dielectric constant of the second electrically conducting wire is changed by iteratively removing a particular portion along a particular length of the second dielectric material farthest from the first electrically conducting wire until the propagation skew between the first electrically conducting wire and the second electrically conducting wire is reduced to below a desired threshold.

2. The cable of claim 1, wherein the second dielectric constant of the second electrically conducting wire is changed to mitigate the signal propagation skew.

3. The cable of claim 1, wherein the second dielectric constant of the second electrically conducting wire is decreased by the removing the particular portion of the second dielectric material.

4. The cable of claim 3, wherein the particular portion of the second dielectric material is removed proximate a terminal end of the second electrically conducting wire.

5. The cable of claim 4, wherein the terminal end of the second electrically conducting wire is covered with a protective cover subsequent to removing the particular portion of the second dielectric material.

6. The cable of claim 1, wherein the cable is electrically complete prior to removing the particular portion of the second dielectric material.

7. The cable of claim 1, wherein an increase in propagation speed of the second electrically conducting wire is based on an amount of the particular portion along the particular length of the second dielectric material removed.

8. A cable comprising:

a first electrically conducting wire with a first circumference and a first length, the first circumference surrounded by a first dielectric material for a portion of the first length; and a second electrically conducting wire with a second circumference and a second length, the second circumference surrounded by a second dielectric material for a portion of the second length, wherein the first electrically conducting wire and the second electrically conducting wire form a pair of conducting wires, and wherein a signal propagation skew between the first electrically conducting wire and the second electrically conducting wire is detected, wherein signal travels faster over the first electrically conducting wire than the second electrically conducting wire, and a first dielectric constant of the first electrically conducting wire is changed to mitigate the signal propagation skew, wherein the first dielectric constant of the first electrically conducting wire is changed by iteratively adding a third dielectric material to a terminal end of the first electrically conducting wire until the signal propagation skew between the first electrically conducting wire and the second electrically conducting wire is below a threshold.

9. The cable of claim 8, wherein the first dielectric constant of the first electrically conducting wire is increased by adding the third dielectric material.

10. The cable of claim 9, wherein the third dielectric material is added to the terminal end of the first electrically conducting wire.

11. The cable of claim 8, wherein the terminal end is covered with a protective cover subsequent to adding the third dielectric material.

12. The cable of claim 11, wherein the cable is electrically complete prior to adding the third dielectric material.

* * * * *